US007679565B2

(12) United States Patent
Sorvala

(10) Patent No.: US 7,679,565 B2
(45) Date of Patent: Mar. 16, 2010

(54) CHIP ANTENNA APPARATUS AND METHODS

(75) Inventor: Juha Sorvala, Oulu (FI)

(73) Assignee: Pulse Finland Oy (FI)

( * ) Notice: Subject to any disclaimer, the term of this patent is extended or adjusted under 35 U.S.C. 154(b) by 224 days.

(21) Appl. No.: 11/648,431

(22) Filed: Dec. 28, 2006

(65) Prior Publication Data

US 2007/0152885 A1 Jul. 5, 2007

Related U.S. Application Data

(63) Continuation of application No. PCT/FI2005/050089, filed on Mar. 16, 2005.

(30) Foreign Application Priority Data

Jun. 28, 2004 (FI) ..... 20040892

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 4,069,483 A * 1/1978 Kaloi ..... 343/700 MS
5,157,363 A 10/1992 Puurunen
5,281,326 A 1/1994 Galla
5,298,873 A 3/1994 Ala-Kojola
5,349,700 A 9/1994 Parker
5,382,959 A * 1/1995 Pett et al. ..... 343/700 MS (Continued)

FOREIGN PATENT DOCUMENTS

EP 0 376 643 A2 4/1990

(Continued)

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waelsallErockwellcollins.com and blhauck@rockwellcollins.com.

(Continued)

*Primary Examiner*—Tho G Phan
(74) *Attorney, Agent, or Firm*—Gazdzinski & Associates, PC

(57) ABSTRACT

A chip component with dielectric substrate and plurality of radiating antenna elements on the surface thereof. In one embodiment, two (2) substantially symmetric elements are used, each covering an opposite head and upper surface portion of the device. The surface between the elements comprises a slot. The chip is mounted on a circuit board (e.g., PCB) whose conductor pattern is part of the antenna. No ground plane is used under the chip or its sides to a certain distance. One of the antenna elements is coupled to the feed conductor on the PCB and to the ground plane, while the parasitic element is coupled only to the ground plane. The parasitic element is fed through coupling over the slot, and both elements resonate at the operating frequency. The antenna can be tuned and matched without discrete components, is substantially omni-directional, and has low substrate losses due to simple field image.

44 Claims, 5 Drawing Sheets

U.S. PATENT DOCUMENTS

| | | | | |
|---|---|---|---|---|
| RE34,898 | E | 4/1995 | Turunen | |
| 5,408,206 | A | 4/1995 | Turunen | |
| 5,506,554 | A | 4/1996 | Ala-Kojola | |
| 5,521,561 | A | 5/1996 | Yrjola | |
| 5,550,519 | A | 8/1996 | Korpela | |
| 5,675,301 | A | 10/1997 | Nappa | |
| 5,764,190 | A | 6/1998 | Murch et al. | |
| 5,892,490 | A | 4/1999 | Asakura et al. | |
| 5,903,820 | A | 5/1999 | Hagstrom | |
| 6,133,879 | A * | 10/2000 | Grangeat et al. | 343/700 MS |
| 6,147,650 | A | 11/2000 | Kawahata et al. | |
| 6,177,908 | B1 | 1/2001 | Kawahata | |
| 6,195,049 | B1 | 2/2001 | Kim et al. | |
| 6,323,811 | B1 | 11/2001 | Tsubaki | |
| 6,404,394 | B1 * | 6/2002 | Hill | 343/702 |
| 6,683,573 | B2 | 1/2004 | Park | |
| 6,781,545 | B2 | 8/2004 | Sung | |
| 6,950,066 | B2 | 9/2005 | Hendler et al. | |
| 7,099,690 | B2 | 8/2006 | Milosavljevic | |
| 7,126,546 | B2 | 10/2006 | Annamaa | |
| 7,136,019 | B2 | 11/2006 | Mikkola | |
| 7,148,851 | B2 | 12/2006 | Takaki et al. | |
| 7,352,326 | B2 | 4/2008 | Korva | |
| 2002/0145569 | A1 | 10/2002 | Onaka | |
| 2002/0196192 | A1 | 12/2002 | Nagumo et al. | |
| 2003/0020659 | A1 | 1/2003 | Kushihi | |
| 2003/0092420 | A1 | 5/2003 | Sugimoto et al. | |
| 2004/0090382 | A1 | 5/2004 | Kushihi et al. | |
| 2005/0024272 | A1 | 2/2005 | Ponce De Leon et al. | |
| 2005/0078037 | A1 | 4/2005 | Leclerc et al. | |
| 2005/0243001 | A1 | 11/2005 | Miyata et al. | |
| 2006/0145924 | A1 | 7/2006 | Chen et al. | |
| 2007/0152885 | A1 | 7/2007 | Sorvala | |
| 2007/0159399 | A1 | 7/2007 | Perunka | |
| 2007/0171131 | A1 | 7/2007 | Sorvala | |
| 2007/0241970 | A1 | 10/2007 | Thornell-Pers | |
| 2008/0088511 | A1 | 4/2008 | Sorvala | |
| 2008/0303729 | A1 | 12/2008 | Milosavljevic | |

FOREIGN PATENT DOCUMENTS

| | | | |
|---|---|---|---|
| EP | 0 759 646 | A1 | 2/1997 |
| EP | 0 766 341 | | 2/1997 |
| EP | 0 766 340 | | 4/1997 |
| EP | 0 831 547 | A2 | 3/1998 |
| EP | 0 942 488 | A2 | 9/1999 |
| EP | 1 003 240 | A2 | 5/2000 |
| EP | 1 052 723 | | 11/2000 |
| EP | 1 063 722 | A2 | 12/2000 |
| EP | 1 102 348 | | 5/2001 |
| EP | 1 113 524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1 248 316 | | 9/2002 |
| EP | 1 267 441 | | 12/2002 |
| EP | 1 294 049 | A1 | 3/2003 |
| EP | 1 351 334 | | 8/2003 |
| EP | 1 414 108 | | 4/2004 |
| EP | 1 432 072 | | 6/2004 |
| EP | 1 453 137 | | 9/2004 |
| EP | 1 482 592 | | 12/2004 |
| JP | 7249923 | | 9/1995 |
| JP | 10 028013 | | 1/1998 |
| JP | 10 209733 | | 8/1998 |
| JP | 11 004117 | | 1/1999 |
| JP | 11 355033 | | 12/1999 |
| JP | 2004112028 | | 4/2004 |
| JP | 2004363859 | | 12/2004 |
| JP | 2005005985 | | 1/2005 |
| KR | 10-2006-7027462 | | 12/2002 |
| WO | WO 00/36700 | | 6/2000 |
| WO | WO 01/33665 | | 5/2001 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/038981 | A1 | 4/2005 |
| WO | WO 2005/055364 | | 6/2005 |

OTHER PUBLICATIONS

O. Kivekas, et al.; "Frequency-tunable internal antenna for mobile phones", Proceedings of 12èmes Journées Internationales de Nice sur les Antennes, 12th Int'l Symposium on Antennas (JINA 2002), vol. 2, 2002, Nice, France, s.53-56, tiivistelmä.

* cited by examiner

CHIP ANTENNA APPARATUS AND METHODS

PRIORITY AND RELATED APPLICATIONS

This is a continuation application of and claims priority to International PCT Application No. PCT/FI2005/050089 having an international filing date of Mar. 16, 2005, which claims priority to Finland Patent Application No. 20040892 filed Jun. 28, 2004, each of the foregoing incorporated herein by reference in its entirety.

This application is related to co-owned and co-pending U.S. patent application Ser. No. 11/544,173 filed Oct. 5, 2006 and entitled "Multi-Band Antenna With a Common Resonant Feed Structure and Methods", and co-owned and co-pending U.S. patent application Ser. No. 11/603,511 filed Nov. 22, 2006 and entitled "Multiband Antenna Apparatus and Methods", each also incorporated herein by reference in its entirety. This application is also related to co-owned and co-pending U.S. patent application Ser. No. 11/648,429 filed contemporaneously herewith and entitled "Antenna, Component And Methods", also incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates generally to antennas for radiating and/or receiving electromagnetic energy, and specifically in one aspect to an antenna in which the radiators are conductor coatings of a dielectric chip; the chip may be, e.g., mounted on a circuit board of a radio device, wherein the circuit board is a part of the antenna structure.

2. Description of Related Technology

In small-sized radio devices, such as mobile phones, the antenna or antennas are preferably placed inside the cover of the device, and naturally the intention is to make them as small as possible. An internal antenna has usually a planar structure so that it includes a radiating plane and a ground plane below it. There is also a variation of the monopole antenna, in which the ground plane is not below the radiating plane but farther on the side. In both cases, the size of the antenna can be reduced by manufacturing the radiating plane on the surface of a dielectric chip instead of making it air-insulated. The higher the dielectricity of the material, the smaller the physical size of an antenna element of a certain electric size. The antenna component becomes a chip to be mounted on a circuit board. However, such a reduction of the size of the antenna entails the increase of losses and thus a deterioration of efficiency.

FIG. 1 shows a chip antenna known from the publications EP 1 162 688 and U.S. Pat. No. 6,323,811, in which antenna there are two radiating elements side by side on the upper surface of the dielectric substrate 110. The first element 120 is connected by the feed conductor 141 to the feeding source, and the second element 130, which is a parasitic element, by a ground conductor 143 to the ground. The resonance frequencies of the elements can be arranged to be different in order to widen the band. The feed conductor and the ground conductor are on a lateral surface of the dielectric substrate. On the same lateral surface, there is a matching conductor 142 branching from the feed conductor 141, which matching conductor is connected to the ground at one end. The matching conductor extends so close to the ground conductor 143 of the parasitic element that there is a significant coupling between them. The parasitic element 130 is electromagnetically fed through this coupling. The feed conductor, the matching conductor and the ground conductor of the parasitic element together form a feed circuit; the optimum matching and gain for the antenna can then be found by shaping the strip conductors of the feed circuit. Between the radiating elements, there is a slot 150 running diagonally across the upper surface of the substrate, and at the open ends of the elements, i.e. at the opposite ends as viewed from the feeding side, there are extensions reaching to the lateral surface of the substrate. By means of such design, as well by the structure of the feed circuit, it is aimed to arrange the currents of the elements orthogonally so that the resonances of the elements would not weaken each other.

A drawback of the above described antenna structure is that in spite of the ostensible optimization of the feed circuit, waveforms that increase the losses and are effectively useless with regard to the radiation produced by the device are created in the dielectric substrate. The efficiency of the antenna is thus comparatively poor and not satisfactory. In addition, there is significant room for improvement if a relatively even radiation pattern, or omnidirectional radiation, is required.

SUMMARY OF THE INVENTION

The present invention addresses the foregoing needs by disclosing antenna component apparatus and methods.

In a first aspect of the invention, an antenna is disclosed. In one embodiment, the antenna comprises: a dielectric substrate having a first dimension and a second dimension, the dielectric substrate being disposed on a mounting substrate and at least partially coupled to a ground plane; a conductive layer having a first portion and a second portion to form a first resonant element and a second resonant element respectively; an electromagnetic coupling element disposed between the first portion and the second portion; and a feed structure connected to the first portion and coupled through the electromagnetic coupling element to the second portion so as to form a resonant structure between the first resonant element, the second resonant element, the mounting substrate, and the ground plane.

In another embodiment, the antenna is manufactured according to the method comprising: mounting a dielectric element at least partially on a ground plane disposed on a substrate; disposing a conductive first portion at least partially on an upper surface and a first side surface of the dielectric element, and a conductive second portion at least partially on an upper surface and a second side surface of the dielectric element; disposing a feed structure asymmetrically coupled to at least one edge or side of the first portion or the second portion; and forming a mutual coupling region between the first portion and the second portion to adjust an antenna resonant frequency.

In still another embodiment, the antenna comprises a dielectric substrate having an upper surface and a lower surface; and at least two radiating elements mounted at least partially on the upper surface and one of the at least two radiating elements partially coupled along exterior edges to a ground plane partially connected to the lower surface. The at least two radiating elements are separated by a slot, the slot adapted to increase an effective electrical length of the at least two radiating elements; and a resonant structure configured so that the operation of the antenna is responsive to at least one of the following: i.) a dimension of the slot; ii.) a dimension of each of the at least two radiating elements, iii.) a separation length of the ground plane from an exterior surface of the antenna, and iv.) a feed connection point connecting to one of the at least two radiating elements.

In yet another embodiment, the antenna comprises a high-efficiency antenna resulting from use of an antenna component that is comparatively simple in structure, and which allows for an uncomplicated current distribution within the antenna elements, and correspondingly a simple field image in the substrate without superfluous or ancillary waveforms.

In a second aspect of the invention, a radio frequency device is disclosed. In one embodiment, the device comprises: an antenna deposited on a dielectric substrate; a conductive coating deposited on the dielectric substrate, the conductive coating having a first portion comprising a first resonator and a second portion comprising a second resonator. The first resonator and the second resonator are separated at respective open ends by a distance d so as to at least in part determine an operating frequency. The device further comprises a feed structure coupled to the conductive coating; and a resonant structure formed by the first resonator, the second resonator, the substrate, and a ground plane deposited on the substrate, the structure configured to operate substantially within a selected frequency band.

In another embodiment, the device comprises a substrate; a conductive surface adapted to form a ground plane; an antenna comprising a dielectric element having a longitudinal direction and a transverse direction, the element being deposited at least partially on the ground plane; a conductive coating deposited on the dielectric element, the conductive coating having a first portion forming a first resonator and a second portion forming a second resonator; and a feed structure coupled to the conductive coating. Open ends of the first resonator and the second resonator are separated by a non-conductive slot to at least electromagnetically couple the first resonator and the second resonator, and to form a resonant structure with the substrate and the ground plane.

In a third aspect of the invention, a method for tuning an antenna is disclosed. In one embodiment, the antenna is disposed on a substrate, and the method comprises: setting an electrical length of a first conductive element between the first portion of a first radiating element and a ground plane; setting an electrical length of a second conductive element between the second portion of a second radiating element to the ground plane to achieve frequency tuning of the antenna; setting at least one of a feed structure length or connection point to the first portion of the radiating element; setting a width or length of a slot element to at least adjust the coupling of energy between the first radiating element and the second radiating element; and setting a spacing of the first radiating element and the second radiating element extended from the ground plane to determine at least in part an omni-directional radiation pattern.

In another embodiment, both the tuning and the matching of the antenna is carried out without discrete components; i.e., by shaping the conductor pattern of the circuit board near the antenna component.

In a fourth aspect of the invention, a chip antenna is disclosed. In one embodiment, the chip antenna comprises: a dielectric substrate with an upper and lower surface, a first and a second head and a first and a second side, and on surface of the substrate a first and a second radiating element; a slot disposed substantially between the elements; the first radiating element connected to a feed conductor of the antenna at a first point and to a ground plane of the radio device at a second point, and the second radiating element connected at a third point to a ground conductor and through it galvanically to the ground plane.

In one variant, and in order to reduce the antenna losses and to provide substantially omnidirectional radiation, the first radiating element comprises a portion covering the first head and another portion covering the upper surface, and the second radiating element comprises a portion covering the second head and another portion covering the upper surface so that the slot extends from the first side to the second side and divides the upper surface to two parts of the substantially same size, over which slot the second radiating element is arranged to obtain a feed electromagnetically.

In a fifth aspect of the invention, a chip component for implementing an antenna of a radio device is disclosed. In one embodiment, the component comprises: a dielectric substrate comprising an upper surface, a lower surface, a first head, a second head, a first side, and a second side; a first antenna element coupled to a feed conductor at a first point and to a ground plane of the radio device at a second point, the first antenna element at least partially disposed on the first head and at least partially on the upper surface; a second antenna element coupled to the ground plane at a third point, the second antenna element at least partially disposed on the second head and at least partially on the upper surface; and a slot extended between at least a portion of the first antenna element and the second antenna element to provide electromagnetic energy to feed the second antenna element.

In another embodiment, the chip component is produced by the method comprising using of a semiconductor technique; i.e., by growing a metal layer on the surface of the substrate (e.g. quartz substrate), and removing a part of it so that the elements remain.

BRIEF DESCRIPTION OF THE DRAWINGS

In the following, the invention will be described in more detail. Reference will be made to the accompanying drawings, wherein.

DETAILED DESCRIPTION OF THE INVENTION

Reference is now made to the drawings wherein like numerals refer to like parts throughout.

As used herein, the terms "wireless", "radio" and "radio frequency" refer without limitation to any wireless signal, data, communication, or other interface or radiating component including without limitation Wi-Fi, Bluetooth, 3G (3GPP/3GPPS), HSDPA/HSUPA, TDMA, CDMA (e.g., IS-95A, WCDMA, etc.), FHSS, DSSS, GSM, UMTS, PAN/802.15, WiMAX (802.16), 802.20, narrowband/FDMA, OFDM, PCS/DCS, analog cellular, CDPD, satellite systems, millimeter wave, or microwave systems.

Additionally, as used herein, the term "chip antenna" means without limitation an antenna structure comprising a chip component. In addition to the actual chip component itself, the structure may comprise the ground arrangement surrounding it and the antenna feed arrangement.

Figure 2:
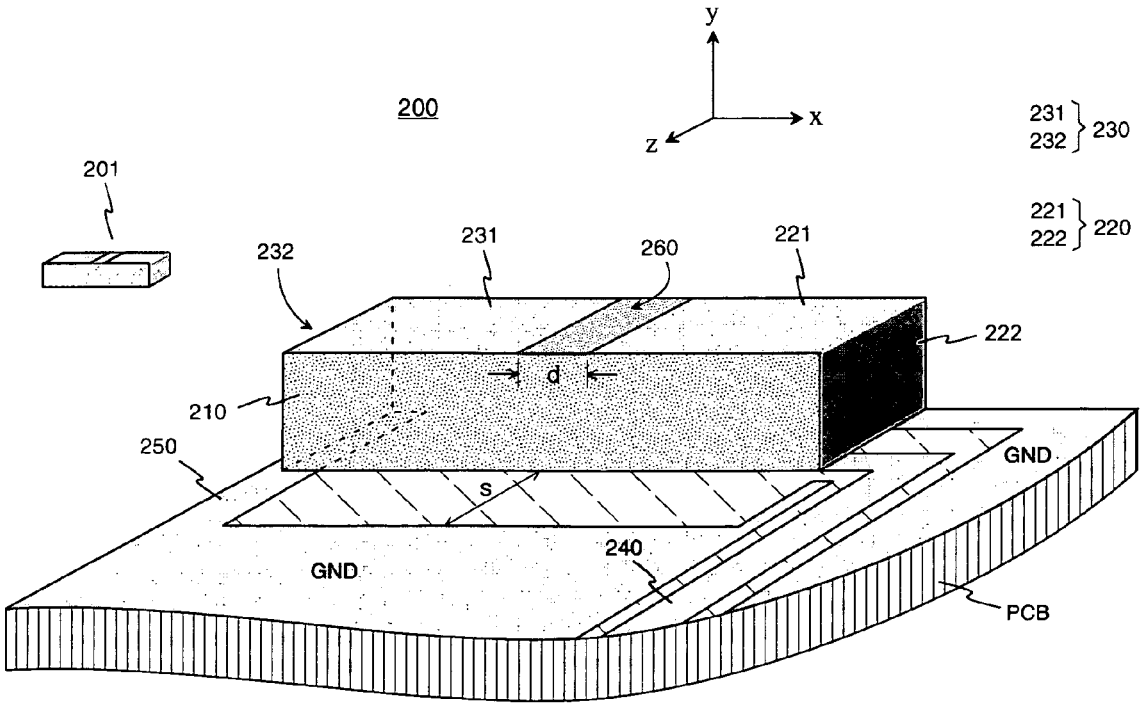
FIG. 2 presents an example of a chip antenna according to the invention.
Figure 4A:
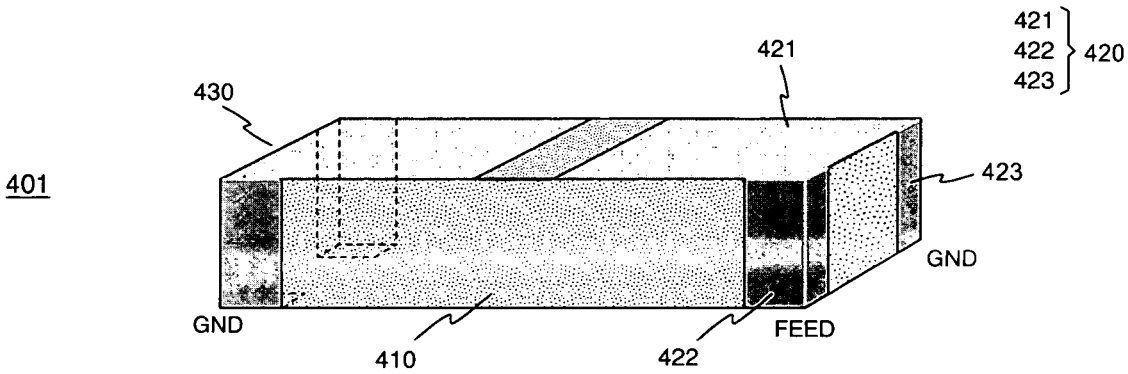
FIGS. 4*a* and 4*b* present another example of the chip component of an antenna according to the invention.

It will further be appreciated that as used herein, the qualifiers "upper" and "lower" refer to the relative position of the antenna shown in FIGS. 2 and 4*a*, and have nothing to do with the position in which the devices are used, and in no way are limiting, but rather merely for convenient reference.

Overview In one salient aspect, the present invention comprises a chip component (and antenna formed therefrom) which overcomes the aforementioned deficiencies of the prior art.

Specifically, one embodiment of the invention comprises a plurality (e.g., two) radiating antenna elements on the surface of a dielectric substrate chip. Each of them is substantially symmetric and of a similar or same size, and covers one of the opposing heads, and part of the upper surface of the (e.g., rectangular) chip. In the middle of the upper surface between the elements is formed a slot. The circuit board or other substrate, on which the chip component is mounted, has no ground plane under the chip nor on its sides up to a certain distance. The lower edge of one of the radiating elements is galvanically connected to the antenna feed conductor on the circuit board, and at another point to the ground plane, while the lower edge of the opposite radiating element, or the parasitic element, is galvanically connected only to the ground plane. The parasitic element obtains its feed through said electromagnetic coupling, and both elements resonate with substantially equal strength at the operating frequency.

In one embodiment, the aforementioned component is manufactured by a semiconductor technique; e.g., by growing a metal layer on the surface of quartz or other type of substrate, and removing a part of it so that the elements remain.

In addition, the invention has the advantage that the efficiency of an antenna made using such a component is high, in spite of the use of the dielectric substrate. This is due to the comparatively. simple structure of the antenna, which produces an uncomplicated current distribution in the antenna elements, and correspondingly a simple field image in the substrate without "superfluous" waveforms.

Moreover, the invention has an excellent omnidirectional radiation profile, which is largely due to the symmetrical structure, shaping of the ground plane, and the nature of the coupling between the elements.

A still further advantage of the invention is that both the tuning and the matching of an antenna can be carried out without discrete components; i.e., just by changing the width of the slot, shaping the conductor pattern of the circuit board near the antenna component, etc.

Yet another advantage of the invention is that the antenna according to it is very small and simple and tolerates relatively high field strengths.

DESCRIPTION OF THE EXEMPLARY EMBODIMENTS

Detailed discussions of various exemplary embodiments of the invention are now provided. It will be recognized that while described in terms of particular applications (e.g., mobile devices including for example cellular telephones), materials, components, and operating parameters (e.g., frequency bands), the various aspects of the invention may be practiced with respect to literally any wireless or radio frequency application.

Figure 1:
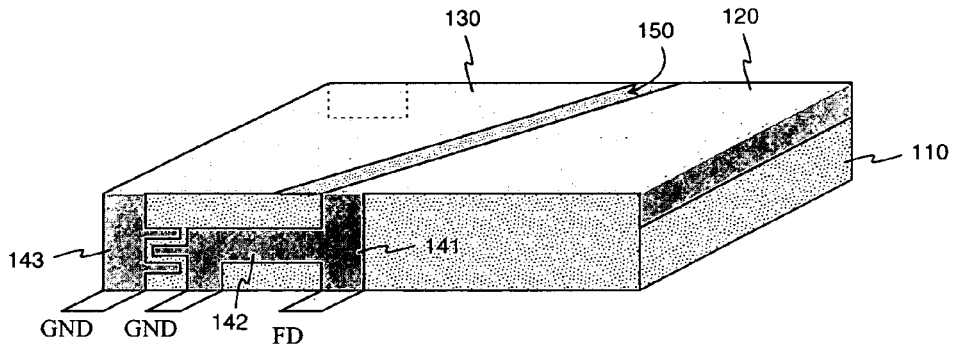
Fig. 1 PRIOR ART
FIG. 1 presents an example of a prior art chip antenna.

FIG. 2 shows an example of a chip antenna according to one embodiment of the invention. The antenna 200 comprises a dielectric substrate chip and a plurality (two in this embodiment) radiating elements on its surface, one of which has been connected to the feed conductor of the antenna and the other which is an electromagnetically fed parasitic element, somewhat akin to the prior art antenna of FIG. 1. However, there are several structural and functional differences between those antennas. In the antenna according to the invention, among other things, the slot separating the radiating elements is between the open ends of the elements and not between the lateral edges.

Moreover, the parasitic element obtains its feed through the coupling prevailing over the slot and not through the coupling between the ground conductor of the parasitic element and the feed conductor. The first radiating element 220 of the antenna 200 comprises a portion 221 partly covering the upper surface of an elongated, rectangular substrate 210 and a head portion 222 covering one head of the substrate. The second radiating element comprises a portion 231 symmetrically covering the upper surface of the substrate partly and a head portion 232 covering the opposite head. Each head portion 222 and 232 continues slightly on the side of the lower surface of the substrate, thus forming the contact surface of the element for its connection. In the middle of the upper surface between the elements there remains a slot 260, over which the elements have an electromagnetic coupling with each other. The slot 260 extends in this example in the transverse direction of the substrate perpendicularly from one lateral surface of the substrate to the other, although this is by no means a requirement for practicing the invention.

The chip component 201, or the substrate with its radiators, is in FIG. 2 on the circuit board (PCB) on its edge and its lower surface against the circuit board. The antenna feed conductor 240 is a strip conductor on the upper surface of the circuit board, and together with the ground plane, or the signal ground GND, and the circuit board material, it forms a feed line having a certain impedance. The feed conductor 240 is galvanically coupled to the first radiating element 220 at a certain point of its contact surface. At another point of the contact surface, the first radiating element is galvanically coupled to the ground plane GND. At the opposite end of the substrate, the second radiating element 230 is galvanically coupled at its contact surface to the ground conductor 250, which is an extension of the wider ground plane GND. The width and length of the ground conductor 250 have a direct effect on the electric length of the second element and thereby on the natural frequency of the whole antenna. For this reason, the ground conductor can be used as a tuning element for the antenna.

The tuning of the antenna is also influenced by the shaping of the other parts of the ground plane, too, and the width d of the slot 260 between the radiating elements. There is no ground plane under the chip component 201, and on the side of the chip component the ground plane is at a certain distance s from it. The longer the distance, the lower the natural frequency. In turn, increasing the width d of the slot increases the natural frequency of the antenna. The distance s also has an effect on its impedance. Therefore the antenna can advantageously be matched by finding the optimum distance of the ground plane from the long side of the chip component. In addition, removing the ground plane from the side of the chip component improves the radiation characteristics of the antenna, such as its omnidirectional radiation.

At the operating frequency, both radiating elements together with the substrate, each other and the ground plane form a quarter-wave resonator. Due to the above described structure, the open ends of the resonators are facing each other, separated by the slot 260, and said electromagnetic coupling is clearly capacitive. The width d of the slot can be dimensioned so that the resonances of both radiators are strong and that the dielectric losses of the substrate are minimized. The optimum width is, for example, 1.2 mm and a suitable range of variation 0.8-2.0 mm, for example. When a ceramic substrate is used, the structure provides a very small size. The dimensions of a chip component of an exemplary Bluetooth antenna operating on the frequency range 2.4 GHz are $2\times2\times7$ mm$^3$, for example, and those of a chip component of a GPS (Global Positioning System) antenna operating at the frequency of 1575 MHz $2\times3\times10$ mm$^3$, for example.

Figure 3:
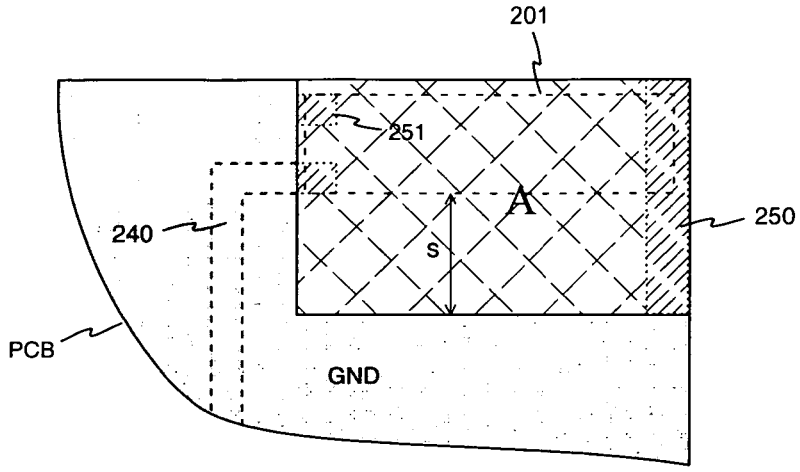
FIG. 3 shows a part of a circuit board belonging to the antenna structure of FIG. 2 from the reverse side.

FIG. 3 shows a part of the circuit board belonging to the antenna structure of FIG. 2 as seen from below. The chip component 201 on the other side of the circuit board (PCB) has been marked with dashed lines in the drawing. Similarly with dashed lines are marked the feed conductor 240, the ground conductor 250 and a ground strip 251 extending under the chip component to its contact surface at the end on the side of the feed conductor. A large part of the lower surface of the circuit board belongs to the ground plane GND. The ground plane is missing from a corner of the board in the area A, which comprises the place of the chip component and an area extending to a certain distance s from the chip component, having a width which is the same as the length of the chip component.

FIG. 4*a* shows another example of the chip component of an antenna according to the invention. The component 401 is mainly similar to the component 201 presented in FIG. 2. The difference is that now the radiating elements extend to the lateral surfaces of the substrate 410 at the ends of the component, and the heads of the substrate are largely uncoated. Thus the first radiating element 420 comprises a portion 421 partly covering the upper surface of the substrate, a portion 422 in a corner of the substrate and a portion 423 in another corner of the same end. The portions 422 and 423 in the corners are partly on the side of the lateral surface of the substrate and partly on the side of the head surface. They continue slightly to the lower surface of the substrate, forming thus the contact surface of the element for its connection. The second radiating element 430 is similar to the first one and is located symmetrically with respect to it. The portions of the radiating elements being located in the corners can naturally also be limited only to the lateral surfaces of the substrate or only to one of the lateral surfaces. In the latter case, the conductor coating running along the lateral surface continues at either end of the component under it for the whole length of the end.

Figure 4B:
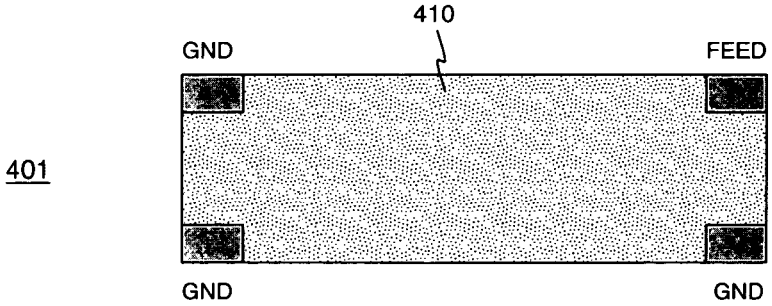

In FIG. 4*b*, the chip component 401 of FIG. 4*a* is seen from below. The lower surface of the substrate 410 and the conductor pads serving as said contact surfaces in its corners are seen in the figure. One of the conductor pads at the first end of the substrate is intended to be connected to the antenna feed conductor and the other one to the ground plane GND. Both of the conductor pads at the second end of the substrate are intended to be connected to the ground plane.

Figure 5:
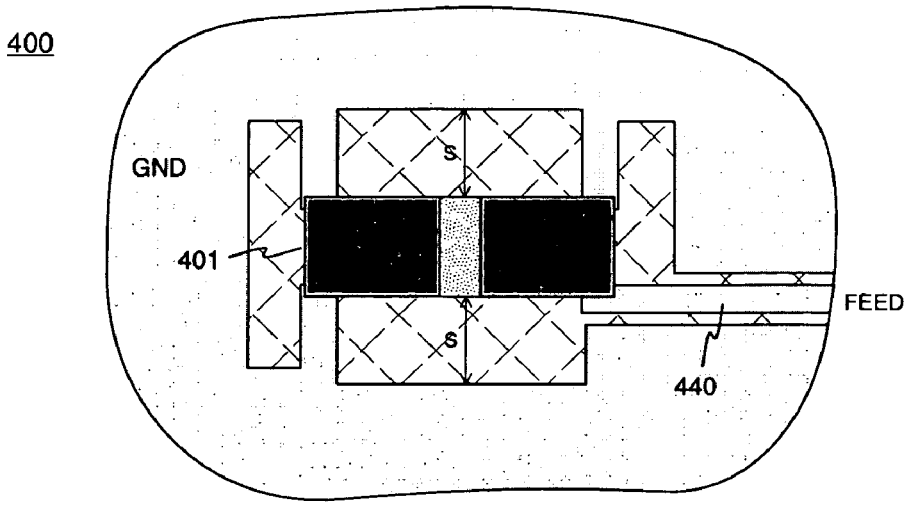
FIG. 5 presents a whole antenna with a chip component according to FIG. 4*a;*

FIG. 5 shows a chip component according to FIGS. 4*a* and 4*b* as mounted on the circuit board so that a whole antenna 400 is formed. Only a small part of the circuit board is visible is this embodiment. Now the chip component 401 is not located at the edge of the circuit board, and therefore there is a groundless area on its both sides up to a certain distance s. The antenna feed conductor 440 is connected to the chip component in one corner of its lower surface, and the ground plane extends to other corners corresponding FIG. 4*b*.

Figure 6A:
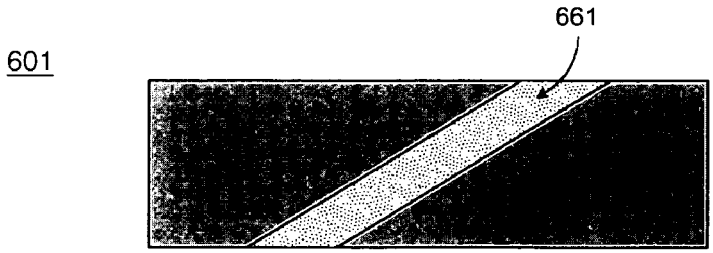
FIGS. 6*a-d* show examples of shaping of the slot between the radiating elements in an antenna according to the invention.

FIGS. 6*a-d* show examples of shaping of the slot between the radiating elements in an antenna according to the invention. In FIG. 6*a*, the antenna's chip component 601 is seen from above and in FIG. 6*b* the chip component 602 is seen from above. Both the slot 661 in component 601 and the slot 662 in component 602 travel diagonally across the upper surface of the component from the first to the second side of the component. The slot 662 is yet more diagonal and thus longer than the slot 661, extending from a corner to the opposite, farthest corner of the upper surface of the chip component. In addition, the slot 662 is narrower than the slot 661. It is mentioned before that broadening the slot increases the natural frequency of the antenna. Vice versa, narrowing the slot decreases the natural frequency of the antenna, or shifts the antenna operation band downwards. Lengthening the slot by making it diagonal affects in the same way, even more effectively.

Figure 6B:
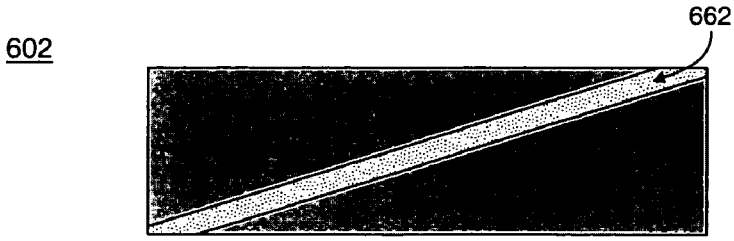
Figure 6C:
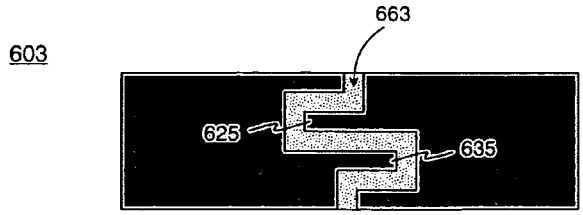
Figure 6D:
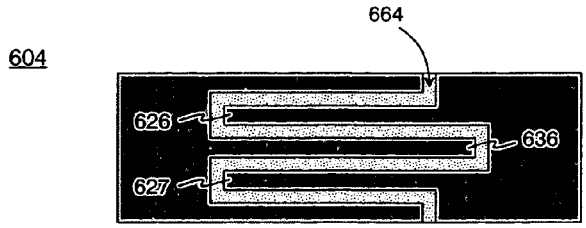

In FIG. 6*c* the antenna's chip component 603 is seen from above, and in FIG. 6*d* the chip component 604 is seen from above. Both the slot 663 in component 603 and the slot 664 in component 604 now have turns. The slot 663 has six rectangular turns so that a finger-like strip 625 is formed in the first radiating element, the strip extending between the regions, which belong to the second radiating element. Symmetrically, a finger-like strip 635 is formed in the second radiating element, this strip extending between the regions, which belong to the first radiating element. The number of the turns in the slot 664 belonging to the component 604 is greater so that two finger-like strips 626 and 627 are formed in the first radiating element, these strips extending between the regions, which belong to the second radiating element. Between these strips there is a finger-like strip 636 as a projection of the second radiating element. The strips in the component 604 are, besides more numerous, also longer than the strips in the component 603, and in addition the slot 664 is narrower than the slot 663. For these reasons the operation band of an antenna corresponding to the component 604 is located lower down than the operation band of an antenna corresponding to the component 603.

Figure 7:
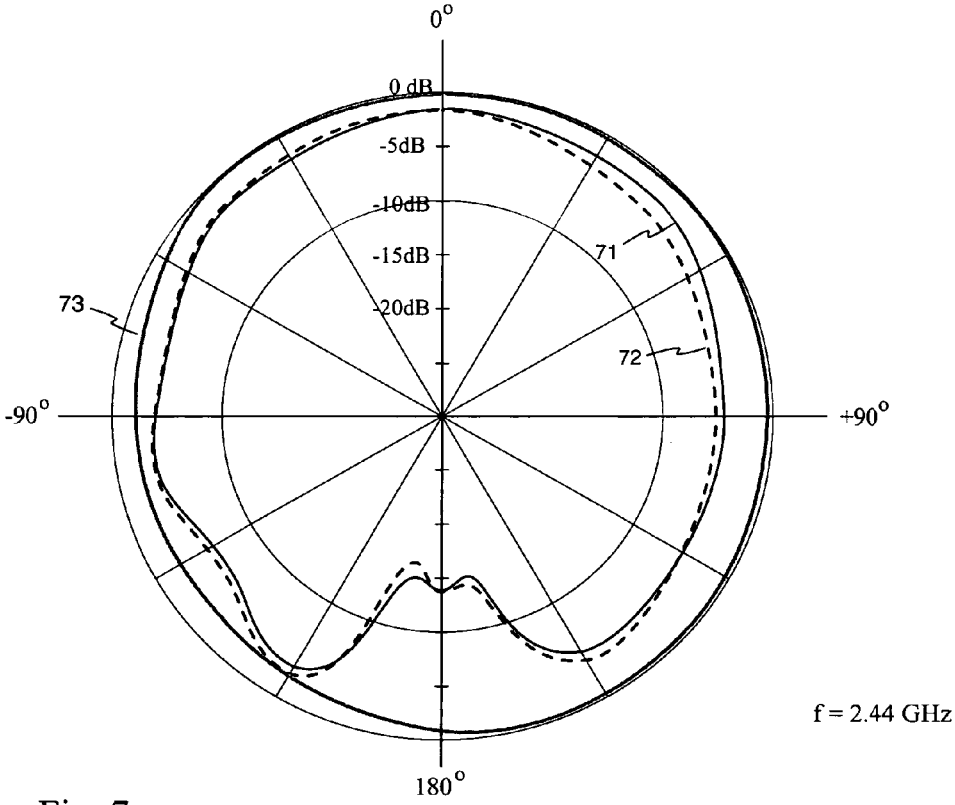
FIG. 7 shows an example of the directional characteristics of an antenna according to the invention, placed in a mobile phone.

FIG. 7 presents an example of the directional characteristics of an antenna according to the invention, being located in a mobile phone. The antenna has been dimensioned for the Bluetooth system. There are three directional patterns in the Figure: (i) the directional pattern 71 presents the antenna gain on plane XZ; (ii) the directional pattern 72 on plane YZ; and (iii) the directional pattern 73 on plane XY; wherein the X axis is the longitudinal direction of the chip component, the Y axis is the vertical direction of the chip component and the Z axis is the transverse direction of the chip component. It is seen from the patterns that the antenna transmits and receives well on all planes and in all directions. On the plane XY in particular, the pattern is substantially even. The two others only have a recess of 10 dB in a sector about 45 degrees wide. The totally "dark" sectors typical in directional patterns do not exist at all.

Figure 8:
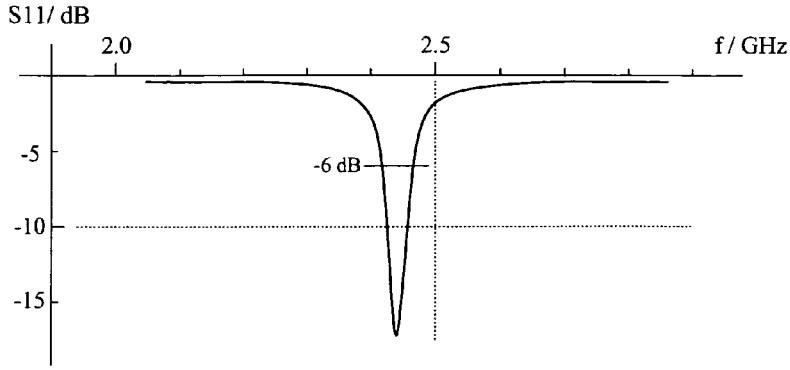
FIG. 8 shows an example of band characteristics of an antenna according to the invention.

FIG. 8 presents an example of the band characteristics of an antenna according to one embodiment of the invention. It presents a curve of the reflection coefficient S11 as a function of frequency. The curve has been measured from the same Bluetooth antenna as the patterns of FIG. 6. If the criterion for the cut-off frequency is the value −6 dB of the reflection coefficient, the bandwidth becomes about 50 MHz, which is about 2% as a relative value. In the center of the operating band, at the frequency of 2440 MHz, the reflection coefficient is −17 dB, which indicates good matching. The Smith diagram shows that in the center of the band, the impedance of the antenna is purely resistive, below the center frequency slightly inductive, and above the centre frequency slightly capacitive, respectively.

Figure 9:
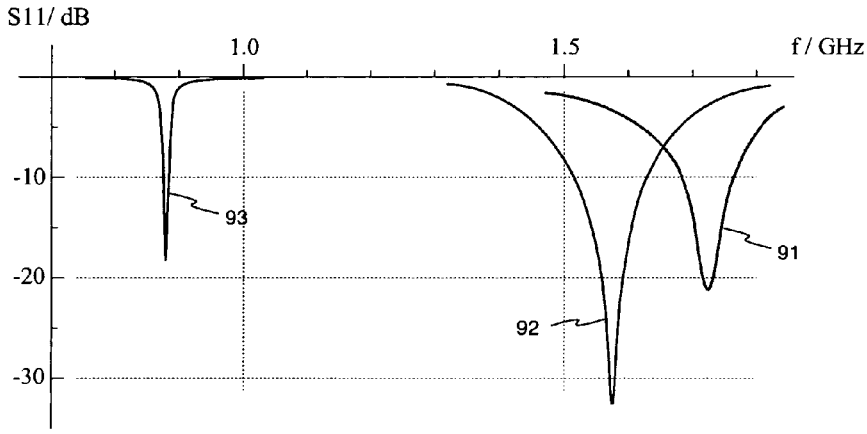
FIG. 9 shows an example of an effect of the shape of the slot between the radiating elements on the place of the antenna operation band.

FIG. 9 presents an example of an effect of the shape of the slot between the radiating elements on the place of the antenna operation band.

The curve 91 shows the fluctuation of the reflection coefficient S11 as a function of frequency in the antenna, the size of the chip component of which is 10×3×4 $mm^3$, and the slot between the radiating elements is perpendicular. The resonance frequency of the antenna, which is approximately the same as the medium frequency of the operation band, falls on the point 1725 MHz.

The curve 92 shows the fluctuation of the reflection coefficient, when the slot between the radiating elements is diagonal according to FIG. 6*b*. In other respects the antenna is similar as in the previous case. Now the resonance frequency of the antenna falls on the point 1575 MHz, the operation band thus being located about 150 MHz lower than in the previous case. The frequency 1575 MHz is used by the GPS (Global Positioning System). A frequency lower than that can in practice be reached in the antenna in question by using a diagonal slot.

The curve 93 shows the fluctuation of the reflection coefficient, when the slot between the radiating elements has turns according to FIG. 6*d* and is somewhat narrower than in the two previous cases. In other respects the antenna is generally similar. Now the operation band of the antenna is lower nearly by a half compared to the case corresponding to the curve 91. The resonance frequency falls on the point 880 MHz, which is located in the range used by the EGSM system (Extended GSM).

A ceramics having the value 20 of the relative dielectric coefficient Fr is used for the antenna in the three cases of FIG. 9. Using a ceramics with a higher Fr value, also the band of an antenna equipped with a diagonal slot can be placed for example in the range of 900 MHz without making the antenna bigger. However, the electric characteristics of the antenna may then be somewhat reduced.

Figure 10:
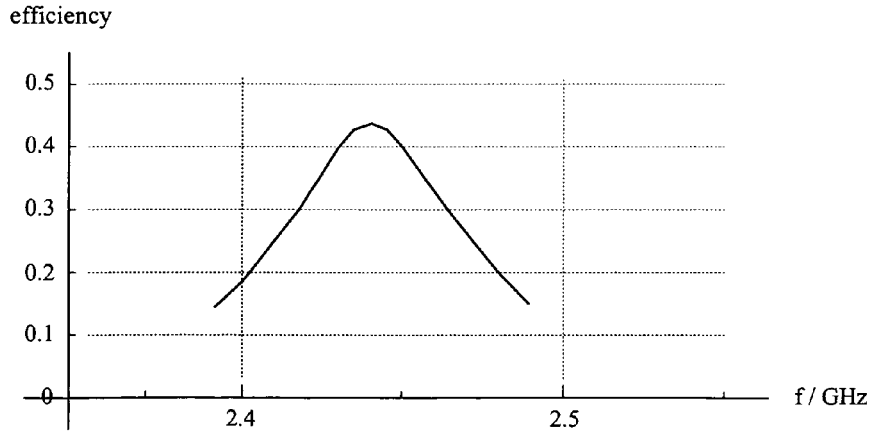
FIG. 10 shows an example of the efficiency of an antenna according to the invention.

FIG. 10 shows an example of the efficiency of an antenna according to the invention. The efficiency has been measured from the same Bluetooth antenna as the patterns of FIGS. 7 and 8. At the centre of the operating band of the antenna the efficiency is about 0.44, and decreases from that to the value of about 0.3 when moving 25 MHz to the side from the centre of the band. The efficiency is considerably high for an antenna using a dielectric substrate.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An antenna comprising:

a dielectric substrate having a first dimension and a second dimension, the dielectric substrate being disposed on a mounting substrate and at least partially coupled to a ground plane;

a conductive layer having a first portion and a second portion to form a first resonant element and a second resonant element respectively;

an electromagnetic coupling element disposed between the first portion and the second portion; and a feed structure connected to the first portion and coupled through the electromagnetic coupling element to the second portion so as to form a resonant structure between the first resonant element, the second resonant element, the mounting substrate, and the ground plane.

2. The antenna of claim 1, wherein the resonant structure comprises a quarter-wave resonator selected to operate substantially within a first frequency range.

3. The antenna of claim 1, wherein the feed structure connected to the first portion comprises a conductive material asymmetrically coupled to the first portion to provide a substantially omni-directional radiation pattern within a first frequency range.

4. The antenna of claim 1, wherein the ground plane comprises a conductive material coupled to a first side of the first resonant element and to a second side of the second resonant element, and distally located relative to the electromagnetic coupling element.

5. The antenna of claim 1, wherein the first resonant element comprises a first conductive patch on a first location adjacent said dielectric substrate, and the second resonant element comprises a second conductive patch on a second location adjacent said dielectric substrate; wherein the first and second conductive patches cooperate to provide a substantially omni-directional antenna radiation pattern.

6. The antenna of claim 1, wherein the electromagnetic coupling element comprises a capacitance electromagnetically coupling the open ends of the first and the second resonant elements so as to lower a natural resonant frequency of the antenna.

7. The antenna of claim 1, wherein the dielectric substrate comprises a ceramic material.

8. The antenna of claim 1, wherein the electromagnetic coupling element comprises a capacitance coupled to open ends of the first resonant element and the second resonant element so as to lower a natural frequency range of the first resonant element and the second resonant element.

9. The antenna of claim 1, wherein the second resonant element comprises a conductive trace coupled to the ground plane and adapted to permit tuning of an antenna frequency response.

10. The antenna of claim 1, wherein the electromagnetic coupling element comprises mutually coupled members between the first resonant element and the second resonant element.

11. A high-efficiency antenna, comprising:

a substrate having a first dimension and a second dimension, the substrate being disposed on a mounting element and at least partially coupled to a ground plane;

an electrically conductive layer having a first portion and a second portion configured so as to form a first resonant element and a second resonant element respectively;

a coupling element disposed electrically between the first portion and the second portion; and a feed structure connected to the first portion and electromagnetically coupled through the coupling element to the second portion so as to form a resonant structure between the first resonant element, the second resonant element, the mounting element, and the ground plane;

wherein said antenna is further configured to produce a substantially omni-directional radiation pattern.

12. The antenna of claim 11, wherein the resonant structure comprises a quarter-wave resonator selected to operate substantially within a first frequency range.

13. The antenna of claim 11, wherein the feed structure connected to the first portion comprises a conductive material asymmetrically coupled to the first portion to provide said substantially omni-directional radiation pattern within a first frequency range.

14. The antenna of claim 11, wherein the ground plane comprises a conductive material coupled to a first side of the first resonant element and to a second side of the second resonant element, and distally located relative to the coupling element.

15. The antenna of claim 11, wherein:

the first resonant element comprises a first conductive patch on a first location adjacent said substrate;

the second resonant element comprises a second conductive patch on a second location adjacent said substrate; and wherein the first and second conductive patches cooperate to provide said substantially omni-directional antenna radiation pattern.

16. The antenna of claim 11, wherein the coupling element comprises a capacitance electromagnetically coupling the open ends of the first and the second resonators so as to lower a natural resonant frequency of the antenna.

17. The antenna of claim 11, wherein the substrate comprises a ceramic material.

18. An antenna comprising:

a dielectric substrate having a first dimension and a second dimension, the dielectric substrate comprising means for disposing the dielectric substrate on a mounting substrate, the means for disposing further comprising means at least partially coupling the dielectric substrate to a ground plane;

a conductive layer having a first portion and a second portion, the first and second portions each having a first resonant means and a second resonant means respectively;

means for electromagnetic coupling the first portion and the second portion; and means for forming a resonant structure between the first resonant means, the second resonant means, the mounting substrate, and the ground plane, the means for forming the resonant structure comprising a feed structure connected to the first portion and coupled through the means for electromagnetic coupling to the second portion.

19. The antenna of claim 18, wherein the means for forming the resonant structure comprises a quarter-wave resonator selected to operate substantially within a first frequency range.

20. The antenna of claim 18, wherein the feed structure connected to the first portion comprises a conductive material asymmetrically coupled to the first portion to provide a substantially omni-directional radiation pattern within a first frequency range.

21. The antenna of claim 18, wherein the ground plane comprises a conductive material coupled to a first side of the first resonant means and to a second side of the second resonant means, and distally located relative to the means for electromagnetic coupling.

22. The antenna of claim 18, wherein the first resonant means comprises a first conductive patch on a first location adjacent said dielectric substrate, and the second resonant means comprises a second conductive patch on a second location adjacent said dielectric substrate; wherein the first and second conductive patches cooperate to provide a substantially omni-directional antenna radiation pattern.

23. The antenna of claim 18, wherein the means for electromagnetic coupling further comprises a capacitance electromagnetically coupling the open ends of the first and the second resonant elements so as to lower a natural resonant frequency of the antenna.

24. The antenna of claim 18, wherein the dielectric substrate comprises a ceramic material.

25. The antenna of claim 18, wherein the means for electromagnetic coupling comprises a capacitance coupled to open ends of the first resonant means and the second resonant means so as to lower a natural frequency range of the first resonant means and the second resonant means.

26. The antenna of claim 18, wherein the second resonant means comprises a conductive trace coupled to the ground plane and means for tuning of an antenna frequency response.

27. The antenna of claim 18, wherein the means for electromagnetic coupling comprises mutually coupled members between the first resonant means and the second resonant means.

28. A high-efficiency antenna, comprising:

a substrate having a first dimension and a second dimension, the substrate comprising one or more attachment elements for disposing the substrate onto a mounting element and for at least partially coupling the substrate to a ground plane;

an electrically conductive layer having a first portion and a second portion configured so as to form a first resonant element and a second resonant element respectively;

a coupling element disposed electrically between the first portion and the second portion; and a feed structure connected to the first portion and electromagnetically coupled through the coupling element to the second portion so as to form a resonant structure between the first resonant element, the second resonant element, the mounting element, and the ground plane;

wherein the antenna is further configured to produce a substantially omni-directional radiation pattern.

29. The antenna of claim 28, wherein the resonant structure comprises a quarter-wave resonator selected to operate substantially within a first frequency range.

30. The antenna of claim 28, wherein the feed structure connected to the first portion comprises a conductive material asymmetrically coupled to the first portion to provide the substantially omni-directional radiation pattern within a first frequency range.

31. The antenna of claim 28, wherein the ground plane comprises a conductive material coupled to a first side of the first resonant element and to a second side of the second resonant element, and distally located relative to the coupling element.

32. The antenna of claim 28, wherein:

the first resonant element comprises a first conductive patch on a first location adjacent the substrate;

the second resonant element comprises a second conductive patch on a second location adjacent the substrate; and wherein the first and second conductive patches cooperate to provide the substantially omni-directional antenna radiation pattern.

33. The antenna of claim 28, wherein the coupling element comprises a capacitance electromagnetically coupling the open ends of the first and the second resonators so as to lower a natural resonant frequency of the antenna.

34. The antenna of claim 28, wherein the substrate comprises a ceramic material.

35. An antenna comprising:

a dielectric substrate having a first dimension and a second dimension, the dielectric substrate comprising one or more attachment elements adapted for disposing the dielectric substrate onto a mounting substrate and at least partially coupling the dielectric substrate to a ground plane;

a conductive layer having a first portion and a second portion to form a first resonant element and a second resonant element respectively;

an electromagnetic coupling element disposed between the first portion and the second portion; and a feed structure connected to the first portion and coupled through the electromagnetic coupling element to the second portion so as to form a resonant structure between the first resonant element, the second resonant element, the mounting substrate, and the ground plane.

36. The antenna of claim 35, wherein the resonant structure comprises a quarter-wave resonator selected to operate substantially within a first frequency range.

37. The antenna of claim 35, wherein the feed structure connected to the first portion comprises a conductive material asymmetrically coupled to the first portion to provide a substantially omni-directional radiation pattern within a first frequency range.

38. The antenna of claim 35, wherein the ground plane comprises a conductive material coupled to a first side of the first resonant element and to a second side of the second resonant element, and distally located relative to the electromagnetic coupling element.

39. The antenna of claim 35, wherein the first resonant element comprises a first conductive patch on a first location adjacent said dielectric substrate, and the second resonant element comprises a second conductive patch on a second location adjacent said dielectric substrate; wherein the first and second conductive patches cooperate to provide a substantially omni-directional antenna radiation pattern.

40. The antenna of claim 35, wherein the electromagnetic coupling element comprises a capacitance electromagnetically coupling the open ends of the first and the second resonant elements so as to lower a natural resonant frequency of the antenna.

41. The antenna of claim 35, wherein the dielectric substrate comprises a ceramic material.

42. The antenna of claim 35, wherein the electromagnetic coupling element comprises a capacitance coupled to open ends of the first resonant element and the second resonant element so as to lower a natural frequency range of the first resonant element and the second resonant element.

43. The antenna of claim 35, wherein the second resonant element comprises a conductive trace coupled to the ground plane and adapted to permit tuning of an antenna frequency response.

44. The antenna of claim 35, wherein the electromagnetic coupling element comprises mutually coupled members between the first resonant element and the second resonant element.

* * * * *